US010663206B2

(12) United States Patent
Sigl et al.

(10) Patent No.: US 10,663,206 B2
(45) Date of Patent: May 26, 2020

(54) HOUSEHOLD COOLING APPLIANCE WITH SPECIFIC EXTERNAL COOLING OF A SUB-UNIT OF THE ICE MAKER

(71) Applicant: BSH HAUSGERAETE GMBH, Munich (DE)

(72) Inventors: Mathias Sigl, Herbrechtingen (DE); Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 121 days.

(21) Appl. No.: 15/621,081

(22) Filed: Jun. 13, 2017

(65) Prior Publication Data

US 2018/0356142 A1 Dec. 13, 2018

(51) Int. Cl.

| | |
|---|---|
| ***F25C 5/20*** | (2018.01) |
| ***F25D 17/06*** | (2006.01) |
| ***F25C 5/04*** | (2006.01) |

(52) U.S. Cl.

CPC ..... *F25C 5/22* (2018.01); *F25C 5/046* (2013.01); *F25D 17/065* (2013.01); *F25C 2400/10* (2013.01); *F25D 2317/00* (2013.01); *F25D 2317/061* (2013.01); *F25D 2323/021* (2013.01)

(58) Field of Classification Search

CPC ..... F25C 2400/10; F25C 5/046; F25C 5/22; F25D 17/065; F25D 2317/00; F25D 2317/061; F25D 2323/021

See application file for complete search history.

(56) References Cited

U.S. PATENT DOCUMENTS

| | | | | |
|---|---|---|---|---|
| 6,351,955 | B1 * | 3/2002 | Oltman | F25C 1/04 62/353 |
| 9,476,631 | B2 * | 10/2016 | Park | F25C 5/046 |
| 2004/0261442 | A1 * | 12/2004 | Chung | F25C 5/046 62/344 |
| 2005/0178145 | A1 * | 8/2005 | Lee | F25D 17/065 62/441 |
| 2006/0248912 | A1 * | 11/2006 | Park | F25C 5/12 62/344 |
| 2008/0034780 | A1 * | 2/2008 | Lim | F25C 1/04 62/353 |
| 2012/0174613 | A1 * | 7/2012 | Park | F25C 5/046 62/320 |
| 2013/0276472 | A1 * | 10/2013 | Mitchell | F25C 1/147 62/344 |
| 2015/0323240 | A1 * | 11/2015 | Klingshirn | F25D 17/062 62/186 |
| 2018/0328641 | A1 * | 11/2018 | Lee | F25D 17/04 |

* cited by examiner

*Primary Examiner* — Henry T Crenshaw
(74) *Attorney, Agent, or Firm* — Laurence A. Greenberg; Werner H. Stemer; Ralph E. Locher

(57) ABSTRACT

A household cooling appliance includes an outer housing, a cooling compartment in the outer housing, and an ice maker unit, which is arranged in the cooling compartment. The ice maker unit includes a first sub-unit, which is configured for making crushed ice from ice form elements. The first sub-unit has a housing. A crusher device for crushing the ice form element is arranged in the housing. A cooling device cools the first sub-unit with cold air. The cooling device has an air duct. The air duct ends at the housing of the first sub-unit and at least partly is configured to extend along an outer side of the housing so that the cold air for cooling the housing flows along the outer side of the housing.

16 Claims, 4 Drawing Sheets

HOUSEHOLD COOLING APPLIANCE WITH SPECIFIC EXTERNAL COOLING OF A SUB-UNIT OF THE ICE MAKER

TECHNICAL FIELD

The invention relates to a household cooling appliance comprising a cooling compartment and an ice maker unit, which is arranged in the cooling compartment. The household cooling appliance comprises a cooling device for specific cooling of a sub-unit of the ice maker with cold air.

BACKGROUND OF THE INVENTION

Household cooling appliances are known in manifold designs. In this connection also appliances are known, which comprise a cooling compartment and a freezer compartment. An ice crusher unit can be arranged in the freezer compartment as well as in the cooling compartment. In the case of appliances, in which this ice maker unit is arranged in the cooling compartment, it is envisaged that the ice maker unit itself is correspondingly thermally insulated. On the other hand in such designs it is then also envisaged that already ice form elements or crushed ice, which is made by the ice maker unit, on the way from the ice maker unit to an output unit of the household cooling appliance has to be cooled correspondingly in order to avoid a defrosting.

From the U.S. Pat. No. 9,476,631 B2 a household cooling appliance is known, in which such ice maker unit is arranged in a cooling compartment. There it is envisaged that cold air is directly conducted into the ice maker unit itself so that the cold air also flows directly towards knives, which are meant to process ice form elements into crushed ice, and are cooled by it. In such a design the passing of cold air through the interior of the housing of the ice maker unit can lead to it that in the very area, where these knives are arranged and possibly then also crushed ice is present, the flowing of the cold air is at least severely impaired. Thereby undesired turbulences and an air congestion in the interior of the ice maker can occur, which is undesired. In the very event if in the region of the ice maker unit, in which these knives are arranged, comprehensively also crushed ice is present, equally a further passing of air up to an ice chute, which is arranged in the flow direction behind these knives, can be severely impaired or prevented. Thereby also an undesired air pressure building up in the ice maker unit, in particular in the flow direction in front of the knives can occur.

By these very flow impairments of the cold air then also regions for instance of the crushed ice, which are arranged already in the direction of the ice chute, can no longer be cooled no longer sufficiently and at least in these regions again a defrosting or melting can occur.

BRIEF SUMMARY OF THE INVENTION

It is the object of the present invention to provide a household cooling appliance, in which the cooling of specific sub-units of the ice maker unit with cold air is improved. This object is solved by a household cooling appliance as claimed.

One aspect of the invention relates to a household cooling appliance comprising an outer housing. The household cooling appliance comprises a cooling compartment in the outer housing. The household cooling appliance comprises an ice maker unit, which is arranged in the cooling compartment, wherein the ice maker unit comprises a first sub-unit, which is configured for making crushed ice from ice form elements. The first sub-unit comprises a housing and in the housing a crusher device for crushing the ice form elements. The household cooling appliance comprises a cooling device for cooling the first sub-unit with cold air, wherein the cooling device comprises an air duct. The air duct ends at the housing of the first sub-unit and is at least partly configured to extend along an outer side of the housing so that the cold air for cooling the housing flows along the outer side of the housing.

Further features of the invention derive from the claims, the figures, and the description of the figures. The features and feature combinations previously named in the description as well as the features and feature combinations named in the following in the description of the figures and/or in the figures alone are usable not only in the respective indicated combination but also in other combinations, without leaving the scope of the invention. Thus, also embodiments of the invention are to be considered as being comprised and disclosed, which are not explicitly shown and explained in the figures, however derive through separated feature combinations from the explained embodiments and can be generated therefrom. Also explanations and feature combinations are to be regarded as disclosed, which thus do not comprise all features of the originally formulated independent claim. Moreover, embodiments and feature combinations, in particular by the above set out embodiments are to be considered as being disclosed, which go beyond the feature combinations set out in the back-references of the claims or deviate therefrom.

BRIEF DESCRIPTION OF THE SEVERAL VIEWS OF THE DRAWINGS

Embodiments of the invention are explained in the following in more detail on the basis of schematic drawings.

DETAILED DESCRIPTION OF PREFERRED EMBODIMENTS

In the figures identical and functionally identical elements are equipped with the same reference signs.

With indications "top", "bottom", "front", "back", "horizontal", "vertical", "depth direction", "width direction", "height direction" etc. the positions and orientations given in the case of intended use and intended arrangement of the ice maker bowl or the device are indicated.

Figure 1:
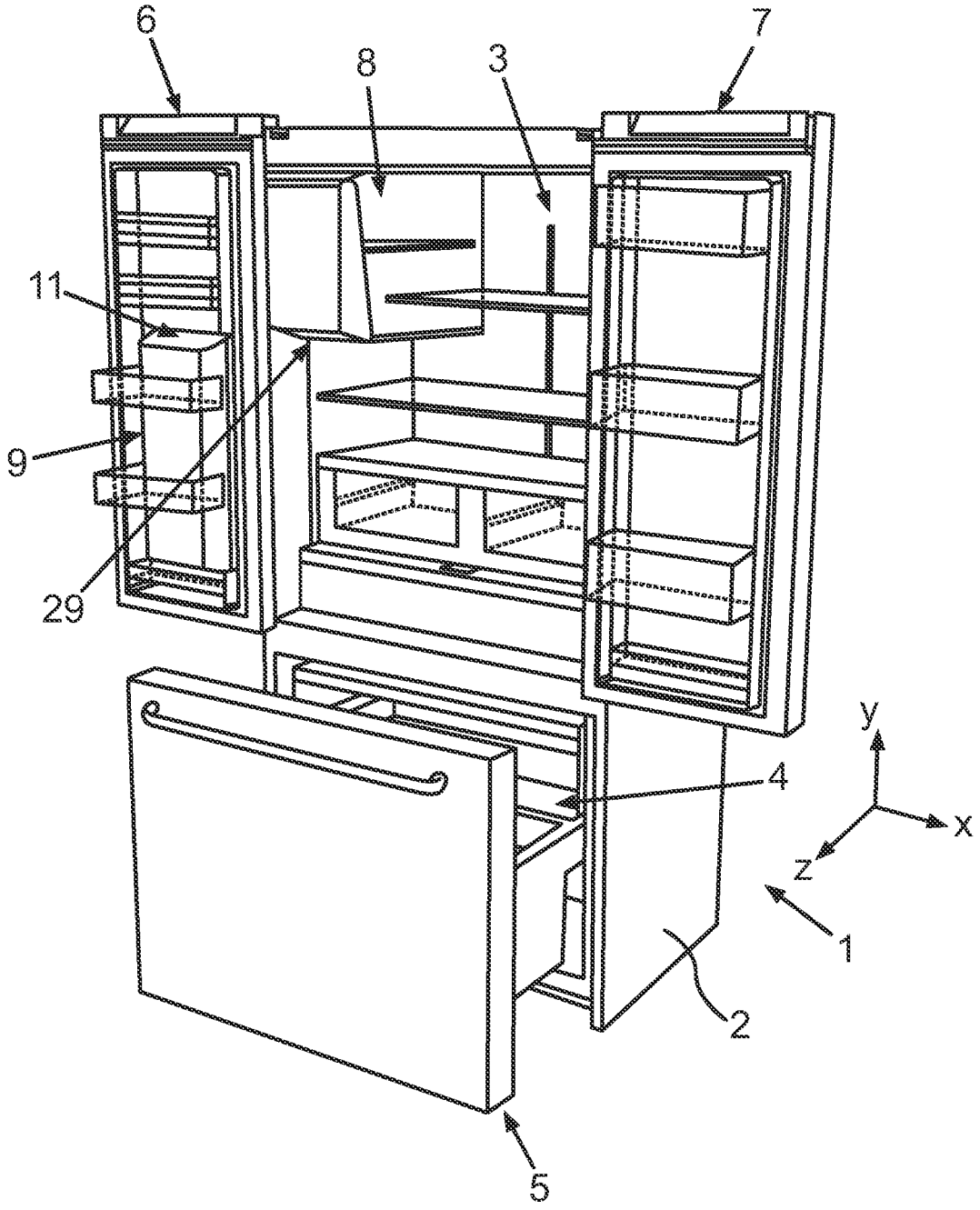
FIG. 1 a perspective view of an embodiment of a household cooling appliance according to the invention.

In FIG. 1 in a perspective view an embodiment of a household cooling appliance 1 is shown. The household cooling appliance 1 is configured for storing and preserving food. In the shown embodiment the household cooling appliance 1 is a fridge-freezer combination. However, it can equally as well be only a cooling appliance.

The shown household cooling appliance 1 comprises an outer housing 2. In the outer housing 2 a first receiving space for food is formed, which here is a cooling compartment 3. The household cooling appliance 1 moreover comprises a second receiving space for food that is separate from the first receiving space and here is a freezer compartment 4. As can be seen, in the embodiment shown here the cooling compartment 3 and the freezer compartment 4 are arranged one above the other in the height direction (y direction) of the household cooling appliance 1. The freezer compartment 4, which is arranged further down, is capable of being closed by a door 5. The door 5 in the shown embodiment is a front wall of a drawer, which can be linearly slid in the depth direction (z direction) of the household cooling appliance 1. The cooling compartment 3 is capable of being closed at the front side by two separate doors 6 and 7, which in FIG. 1 are shown in the opened state. The two separate doors 6 and 7 are capable of being pivoted about pivot axes, which are vertically orientated, and are arranged on the outer housing 2. The two doors 6 and 7 are arranged in the width direction (x direction) next to each other and extend in the closed state in a front side plane. In particular the door 5 in the closed state also extends in this plane, in which also the two doors 6 and 7 extend in the closed state.

The household cooling appliance 1 moreover comprises a dispenser unit, which is configured for dispensing ice form elements or crushed ice. The dispenser unit moreover can also optionally be configured for dispensing a beverage. The dispenser unit comprises an ice maker unit 8. The ice maker unit 8 in the shown embodiment is arranged internally in the cooling compartment 3. This means, whilst the ice maker unit 8 is configured and arranged to be thermally insulated against the cooling compartment 3, that it however is accessible and reachable only via the feeding aperture of the cooling compartment 3. Thus, the ice maker unit 8 can only be made accessible, if at least the door 6 is opened.

The dispenser unit in addition to the ice maker unit 8 also has an output unit 9. The output unit 9 here for instance is integrally formed in the door 6. At an outer side of the door 6 facing away from the cooling compartment 3, which then is also a front side, a niche is formed, into which a collection container can be put and into which then via the output unit 9 the ice form elements or the crushed ice can be dispensed.

Figure 2:
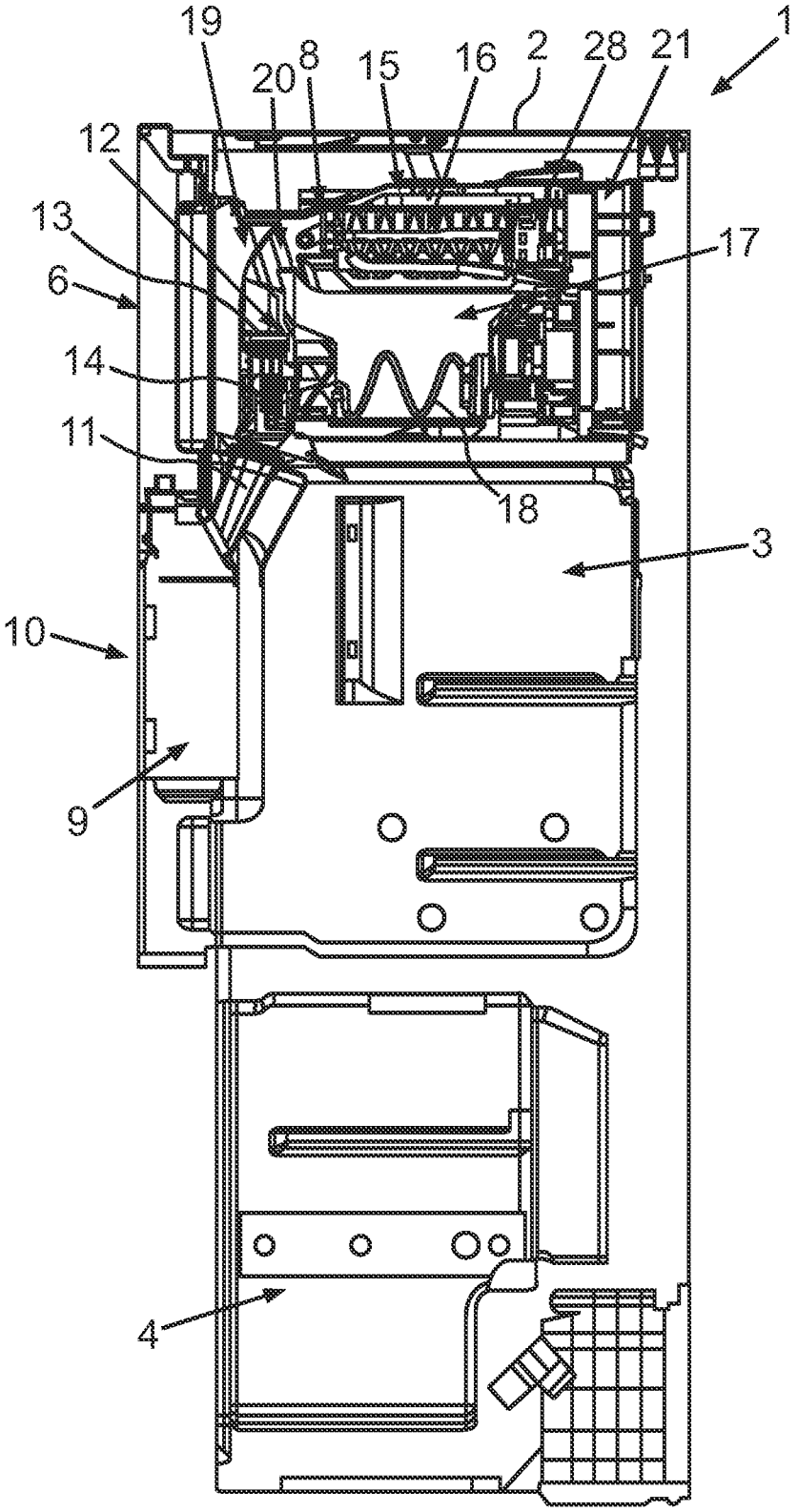
FIG. 2 a view of a vertical section through the household cooling appliance according to FIG. 1.

In FIG. 2 in a vertical sectional view, in which the y-z plane is the sectional plane, the household cooling appliance 1 according to FIG. 1 is shown at least in partial components. The door 5 is not shown in FIG. 2 and the door 6, which is recognizable in the sectional view, is shown in the closed state. The niche 10 already mentioned in the above is shown in a front side of the door 6.

In the closed state of the door 6 the output unit 9 is coupled with the ice maker unit 8 so that via an ice chute 11, which here is formed in the output unit 9, can reach the output unit 9 as ice form elements or crushed ice from the ice maker unit 8.

The ice maker unit 8 has a first sub-unit 12. This first sub-unit 12 is configured for making crushed ice from ice form elements. This first sub-unit 12 has a housing 13, in which a crusher device 14 is arranged. The crusher device 14 is configured for crushing the ice form elements. The crusher device 14 can comprise one knife or several knives.

The ice maker unit 8 moreover comprises a second sub-unit 15. The second sub-unit 15 is configured for making ice form elements. The second sub-unit 15 for this purpose comprises an ice form element bowl 16. In the ice form element bowl 16 mould regions are formed, into which liquid, in particular water, can be inserted, which then freezes therein for making ice form elements.

Moreover, the ice maker unit 8 comprises a container 17, which is arranged below the ice form element bowl 16. The made ice form element can then be put into this container 17 from the ice form element bowl 16. Moreover, the ice maker unit 8 comprises a conveyor unit 18. By this conveyor unit 18 the ice form elements can be conveyed from the container 17 in particular to the first sub-unit 12. Depending on whether or not it is desired to dispense ice form elements or crushed ice, these ice form elements then are crushed in this first sub-unit 12 or are conveyed unchanged through the first sub-unit 12 and to the ice chute 11.

The household cooing appliance 1 also comprises a cooling device 19 for cooling the first sub-unit 12. This cooling device 19 comprises an air duct 20, in which cold air flows to the first sub-unit 12. This air duct ends at the housing 13 of the first sub-unit 12. The air duct 20 moreover is at least partly configured to extend along an outer side of the housing 13 so that the cold air flowing therein for cooling the housing flows along the outer side of the housing 13.

It is in particular envisaged that the air duct 20 outside the housing 13 is arranged in such a way that the cold air flows only outside the housing 13. The cold air thus does not flow into the housing 13 of the first sub-unit 12. The cooling of the first sub-unit 12 thus occurs in particular only on the outer side at the housing 13.

The air duct 20 and thus also the volume of the air duct surrounds the housing 13 at least partly at the outer side of the housing. Preferably the air duct 20 completely surrounds the housing 13 at a ceiling wall, on side walls, and on a front wall of the housing 13. In particular at least some of these named walls of the housing 13 also form boundary walls of the boundary walls of the air duct 20.

For producing cold air an evaporator 21 is provided, which here in the shown embodiment is arranged in the rear portion of the ice maker unit 8.

It may be envisaged that with a ventilator 28 this cold air is conveyed into the second sub-unit 15. The temperature level in this second sub-unit 15 is below the freezing point and thus below 0° C. so that the production of ice form elements is facilitated. Preferably, the cold air P flows from the second sub-unit 15 into the air duct 20, which is fluidically coupled with this first sub-unit 12.

Figure 3:
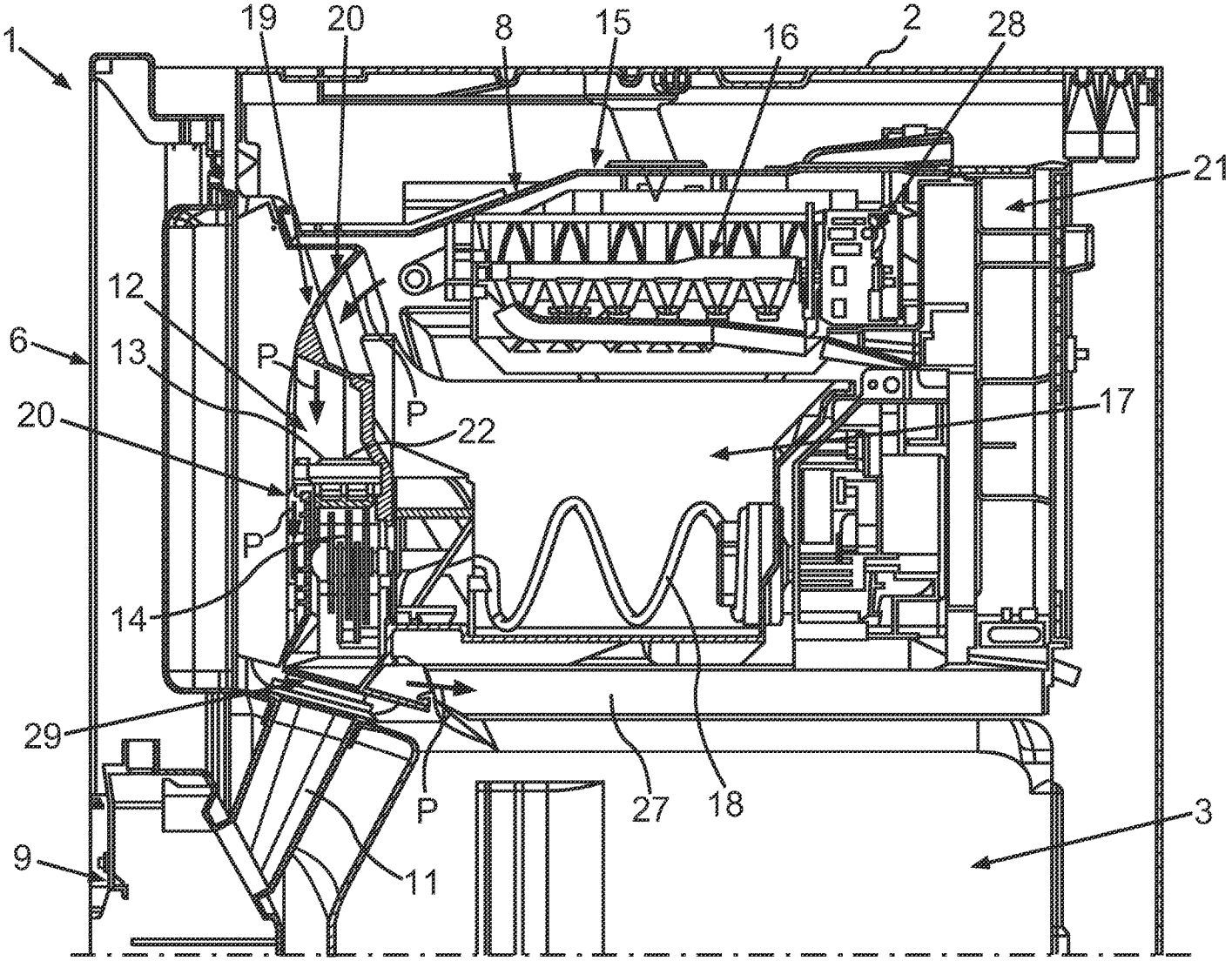
FIG. 3 an enlarged view of a partial section of the household cooling appliance according to FIG. 2.

In an advantageous embodiment it is envisaged that the cold air P upon flowing around the housing 13 is conducted back into the second sub-unit 15, in particular via a further air duct 27 (FIG. 3). Preferably this further air duct 27, which is arranged in the flow direction of the cold air downstream of the first sub-unit 12, flows into the volume space, in which the evaporator 21 is arranged.

It may also be envisaged that the volume space, in which the evaporator 21 is arranged, is coupled with the freezer compartment 4. Cold air can then correspondingly circulate via the freezer compartment 4 and from there then be conducted via the evaporator 21 into the ice maker unit 8.

In FIG. 3 an enlarged view of the view in FIG. 2 is shown, wherein here the ice maker unit 8 is represented enlarged. In FIG. 3 also by the shown arrows the flow path of the cold air P is shown. It can be discerned that the air duct 20 viewed in the height direction of the housing 13 is arranged to extend along a ceiling wall 22 of this housing 13 and the cold air flows along an outer side of this ceiling wall 22.

In particular it is additionally or instead envisaged that the air duct 20 viewed in the height direction of the housing 13 is arranged to extend at least on a side wall 23 (FIG. 4) and/or on a further side wall 24 (FIG. 4) of the housing 13 and cold air flows along an outer side of this side wall 23 and/or 24.

In particular additionally or instead it is envisaged that the air duct 20 viewed in the depth direction of the housing is arranged to extend at least along a front wall 25 of the housing 13 and the cold air flows along an outer side of this front wall 25.

In particular it is envisaged that additionally or instead the air duct 20 viewed in the height direction of the housing 13 is arranged to extend at least on a bottom wall 26 of the housing 13 and the cold air flows along an outer side of the bottom wall 26.

Figure 4:
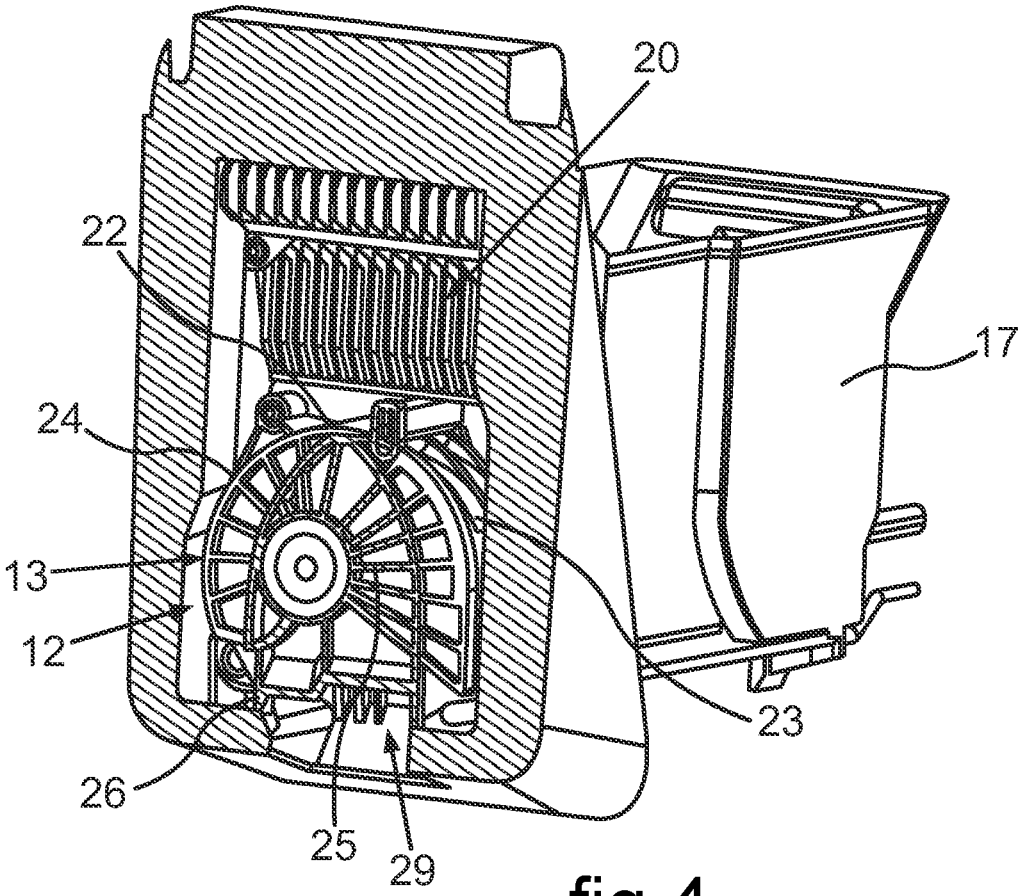
FIG. 4 a perspective view of partial components of an ice maker unit of the household cooling appliance.

The positioning and the design of the housing 13 is shown exemplarily in the perspective view according to FIG. 3. In FIG. 4 for this purpose the front wall of the ice maker unit 8 is shown in the sectional view so that the air duct 20 in FIG. 4 is shown open towards the front. By such design of the air duct 20 a very comprehensive external flow around the housing 13 is facilitated. A very even and invariably comprehensive cooling with cold air is thus rendered possible. This is facilitated even if in the first sub-unit 12 ice form elements or crushed ice are contained. In this very case an immediate contact of the cold air with these ice form elements or the crushed ice is avoided. By this external indirect cooling of the ice form elements or the crushed ice via the cooling of the housing 13 also a very even cooling of the volume area in the interior of the housing 13 can be achieved. A flow congestion of the cold air in the interior of the housing 13 is thereby also avoided.

As can also be recognized in FIG. 2 to FIG. 4, the air duct 20 viewed in the depth direction of household cooling appliance 1 is arranged at the front side and ends towards the front at the upper part of the second sub-unit 15. Moreover, viewed in the height direction coming from the above it extends downwards upon the housing 13. The air duct 20 upstream of the housing 13 ends at this second sub-unit 15 so that the cold air is capable of being conducted from the second sub-unit 15 via the air duct 20 to the housing 13 of the first sub-unit 12 without restriction.

In FIG. 3 a further air duct 27, as it is already mentioned in the above, by which the cold air downstream of the first sub-unit 12 can be conducted back into the second sub-unit 15, is shown in outlines.

In an alternative embodiment additionally or instead it may be envisaged that the air duct 20 is also formed up to the ice chute 11. The cold air, which flows in the air duct 20, can then also be conducted to the ice chute 11 in order to cool same, too. In this connection it may be envisaged that the cold air only on the outer side flows along the ice chute 11 and thus cools the ice chute 11 at its outer side. Additionally or instead it may also be envisaged that the cold air from the air duct 20 can also be directed into the ice chute 11.

As an alternative to the option that the cold air is circulated by means of a ventilator 28 (FIG. 2 and FIG. 3), it may also be envisaged that the flowing of the cold air in the air duct 20 is effected without such ventilator 28 and only by way of convection.

In a further embodiment it may be envisaged that the cold air is directed into the air duct 20 at least partly also into the cooling compartment 3.

In FIG. 3 and in FIG. 4 moreover also an aperture 29 of the housing 13 can be recognized, via which the crushed ice or the ice form elements arrive(s) in the ice chute 11.

In general a household cooling appliance comprising an outer housing, comprising a cooling compartment in the outer housing, and comprising an ice maker unit, which is arranged in the cooling compartment is provided. The ice maker unit in a preferred embodiment comprises a first sub-unit, which is configured for making crushed ice from ice form elements. The first sub-unit has a housing. In the housing preferably a crusher device for crushing the ice form elements is arranged. The household cooling appliance preferably comprises a cooling device, which is configured for cooling the first sub-unit, wherein for this purpose cold air flows towards the first sub-unit on the outer side. The cooling device preferably comprises an air duct. The air duct in particular ends at the housing of the first sub-unit. The air duct at least viewed along its longitudinal axis is arranged with a partial length partly extending along an outer side of the housing so that the cold air for cooling the housing flows along an outer side of the housing.

Walls of the housing, which bound an interior volume of the housing, comprise outer sides facing away from the interior volume. Cold air flows directly towards at least one of these outer sides so that this wall externally is cooled by the cold air. Inner sides of these walls face towards the interior volume.

In a further aspect the air duct viewed in the height direction of the housing is arranged to extend along a ceiling wall of the housing and the cold air flows along an outer side of the ceiling wall. In a further aspect the air duct viewed in the height direction of the housing is arranged to extend at least along a side wall of the housing and the cold air flows along an outer side of the side wall. In a further aspect the air duct viewed in the depth direction of the housing is arranged to extend at least along a front wall of the housing and the cold air flows along an outer side of the front wall. In a further aspect the air duct viewed in the height direction of the housing is arranged to extend at least along a bottom wall of the housing and the cold air flows along an outer side of the bottom wall.

In a further aspect the air duct outside the housing is arranged in such a way that the cold air only flows outside the housing.

In a further aspect the ice maker has a second sub-unit, in which the ice form elements are made, wherein the air duct upstream of the housing ends at the second sub-unit so that cold air is capable of being conducted from the second sub-unit via the air duct towards the housing of the first sub-unit.

In a further aspect the air duct downstream of the first sub-unit ends back at the second sub-unit.

In a further aspect of the invention the household cooling appliance comprises an output unit for dispensing ice form elements or crushed ice. The household cooling appliance comprises an ice chute, which is connected with the first sub-unit and with the output unit and by which ice form elements or crushed ice is capable of being conducted from the first sub-unit to the output unit, wherein the air duct ends at the ice chute and the ice chute is capable of being cooled by cold air in the air duct.

In a further aspect the air duct ends in the ice chute so that cold air can flow into the ice chute.

In a further aspect the air duct ends at an outer side of the ice chute so that cold air can flow along the outer side of the ice chute.

In a further aspect the household cooling device comprises a ventilator, by which the flowing of cold air in the air duct is effected. The ventilator can be arranged in the ice maker.

In a further aspect the household cooling appliance comprises a freezer compartment and the ventilator is arranged in the freezer compartment, wherein the freezer compartment is connected by a further air duct for conducting the cold air with the ice maker.

In a further aspect the air duct downstream of the first sub-unit ends in the cooling compartment.

In a further aspect a freezer compartment is arranged in the outer housing and the freezer compartment is arranged outside the cooling compartment and viewed in the height direction of the household cooling appliance below the cooling compartment. The freezer compartment is preferably capable of being closed at the front side by at least one door of the household cooling appliance. The cooling compartment is preferably capable of being closed at the front side by two separate further doors of the household cooling appliance, wherein the two doors for closing the cooling compartment viewed in the width direction of the household cooling appliance are arranged next to each other.

LIST OF REFERENCES

1 household cooling appliance
2 outer housing
3 cooling compartment
4 freezer compartment
5 door
6 door
7 door
8 ice maker unit
9 output unit
10 niche
11 ice chute
12 first sub-unit
13 housing
14 crusher device
15 second sub-unit
16 ice form element bowl
17 container
18 conveyor unit
19 cooling device
20 air duct
21 evaporator
22 ceiling wall
23 side wall
24 side wall
25 front wall
26 bottom wall
27 air duct
28 ventilator
29 opening
P arrow

The invention claimed is:

1. A household cooling appliance comprising
an outer housing,
a cooling compartment in the outer housing,
an ice maker unit, which is arranged in the cooling compartment,
wherein the ice maker unit comprises a first sub-unit, which is configured for making crushed ice from ice form elements, and a second sub-unit, in which the ice form elements are made
wherein the first sub-unit comprises a housing,
and in the housing a crusher device for crushing the ice form elements is arranged,
a cooling device for cooling the first sub-unit with cold air,
wherein the cooling device comprises an air duct, wherein the air duct ends at the housing of the first sub-unit and at least partly is configured to extend along an outer side of the housing so that the cold air for cooling the housing flows along the outer side of the housing, and the cold air, upon flowing around the housing, is conducted back into the second sub-unit.

2. The household cooling appliance according to claim 1, wherein the air duct viewed in the height direction of the housing is arranged to extend along a ceiling wall of the housing and the cold air flows along an outer side of the ceiling wall.

3. The household cooling appliance according to claim 1, wherein the air duct viewed in a vertical direction of the housing is arranged to extend at least along one side wall of the housing and the cold air flows along an outer side of the side wall.

4. The household cooling appliance according to claim 1, wherein the air duct viewed in the depth direction of the housing is arranged to extend at least along a front wall of the housing and the cold air flows along an outer side of the front wall.

5. The household cooling appliance according to claim 1, wherein the air duct viewed in the height direction of the housing is arranged to extend at least along a bottom wall of the housing and the cold air flows along an outer side of the bottom wall.

6. The household cooling appliance according to claim 1, wherein the air duct outside the housing is arranged in such a way that the cold air flows only outside the housing.

7. The household cooling appliance according to claim 1, wherein the air duct upstream of the housing branches off the second sub-unit so that cold air is capable of being conducted from the second sub-unit via the air channel to the housing of the first sub-unit.

8. The household cooling appliance according to claim 1, wherein
the household cooling appliance comprises an output unit for dispensing ice form elements or crushed ice, and
the household cooling appliance comprises an ice chute, which is connected with the first sub-unit and with the output unit and with which ice form elements or crushed ice is capable of being conducted from the first sub-unit to the output unit, wherein
the air duct ends at the ice chute and the ice chute is capable of being cooled with cold air in the air duct.

9. The household cooling appliance according to claim 8, wherein the air duct ends in the ice chute so that the cold air can flow into the ice chute.

10. The household cooling appliance according to claim 8, wherein the air duct ends at an outer side of the ice chute so that cold air can flow along the outer side of the ice chute.

11. The household cooling appliance according to claim 1, wherein the flowing of the cold air in the air duct is effected by convection.

12. The household cooling appliance according to claim 1, wherein the household cooling appliance comprises a ventilator, by which the flowing of cold air in the air duct is effected.

13. The household cooling appliance according to claim 12, wherein the ventilator is arranged in the ice maker unit.

14. The household cooling appliance according to claim 12, wherein the household cooling appliance comprises a freezer compartment, and the ventilator is arranged in the freezer compartment, wherein the freezer compartment is connected with a further air duct for conducting the cold air with the ice maker unit.

15. The household cooling appliance according to claim 1, wherein the air duct downstream of the first sub-unit ends in the cooling compartment.

16. The household cooling appliance according to claim 1, wherein
a freezer compartment of the household cooling appliance is arranged in the outer housing, and the freezer compartment outside the cooling compartment and viewed in a vertical direction of the household cooling appliance is arranged below the cooling compartment, and the freezer compartment is capable of being closed at the front side by least one door of the household cooling appliance and the cooling compartment is capable of being closed on the front side by two separate further doors of the household cooling appliance, wherein the two doors for closing the cooling compartment viewed in the width direction of the household cooling appliance are arranged next to each other.

* * * * *